United States Patent [19]

Aragou

[11] 4,448,043

[45] May 15, 1984

[54] HEAT EXCHANGER WITH A CAPILLARY STRUCTURE FOR REFRIGERATION EQUIPMENT AND/OR HEAT PUMPS AND METHOD OF MAKING THE SAME

[76] Inventor: Yvan Aragou, 32, Hameau de Russac, 33400 Talence, France

[21] Appl. No.: 347,970

[22] Filed: Feb. 11, 1982

[30] Foreign Application Priority Data

Feb. 13, 1981 [FR] France ..... 81 03033

[51] Int. Cl.[3] ..... F25B 39/02

[52] U.S. Cl. ..... 62/515; 62/527; 165/133

[58] Field of Search ..... 62/515, 527; 165/133

[56] References Cited

U.S. PATENT DOCUMENTS

| | | | |
|---|---|---|---|
| 1,602,890 | 10/1926 | Evans . | |
| 2,448,261 | 8/1948 | Gaugler . | |
| 2,517,654 | 8/1950 | Gaugler . | |
| 2,565,221 | 8/1951 | Gaugler . | |
| 2,691,281 | 10/1954 | Phillips | 165/133 |
| 2,702,460 | 2/1955 | Gaugler . | |
| 3,554,183 | 1/1971 | Grover . | |
| 3,598,177 | 8/1971 | Webster | 165/133 |
| 3,789,920 | 2/1974 | Low et al. . | |
| 3,921,710 | 11/1975 | Katayama . | |
| 4,044,797 | 8/1977 | Fujie et al. | 165/133 |
| 4,074,753 | 2/1978 | Schmittle et al. | 62/527 |

FOREIGN PATENT DOCUMENTS

| | | |
|---|---|---|
| 552459 | 11/1975 | Fed. Rep. of Germany . |
| 327078 | 12/1902 | France . |
| 990531 | 7/1949 | France . |
| 341536 | 8/1962 | France . |
| 1599762 | 9/1968 | France . |
| 2147102 | 7/1972 | France . |
| 2183120 | 5/1973 | France . |
| 2193187 | 7/1973 | France . |
| 433166 | 8/1979 | France . |
| 308966 | 4/1928 | United Kingdom . |

*Primary Examiner*—Ronald C. Capossela

*Attorney, Agent, or Firm*—Schwartz, Jeffery, Schwaab, Mack, Blumenthal & Koch

[57] ABSTRACT

An annular capillary structure is disclosed for tubes of heat exchangers. The capillary structure comprises a series of individual, smooth, rectilinear fibers arranged parallel to the axis of a tube. The fibers are regularly positioned in annular spaces along the inner wall of the tubes. Helical springs or a layer of spring wires urges the fibers into contact with the inner wall of the tube. According to a preferred method of making the structure, a layer of spring steel wires are coiled on a mandrel and a layer of fibers is laid longitudinally thereon. The layer pass through an extruder head and are introduced into the tubular element which has just been extruded.

15 Claims, 8 Drawing Figures

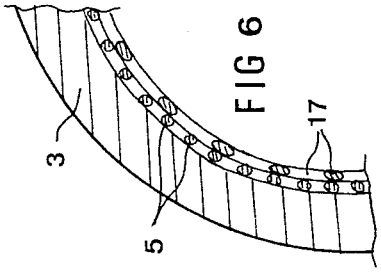
FIG 6
FIG 7
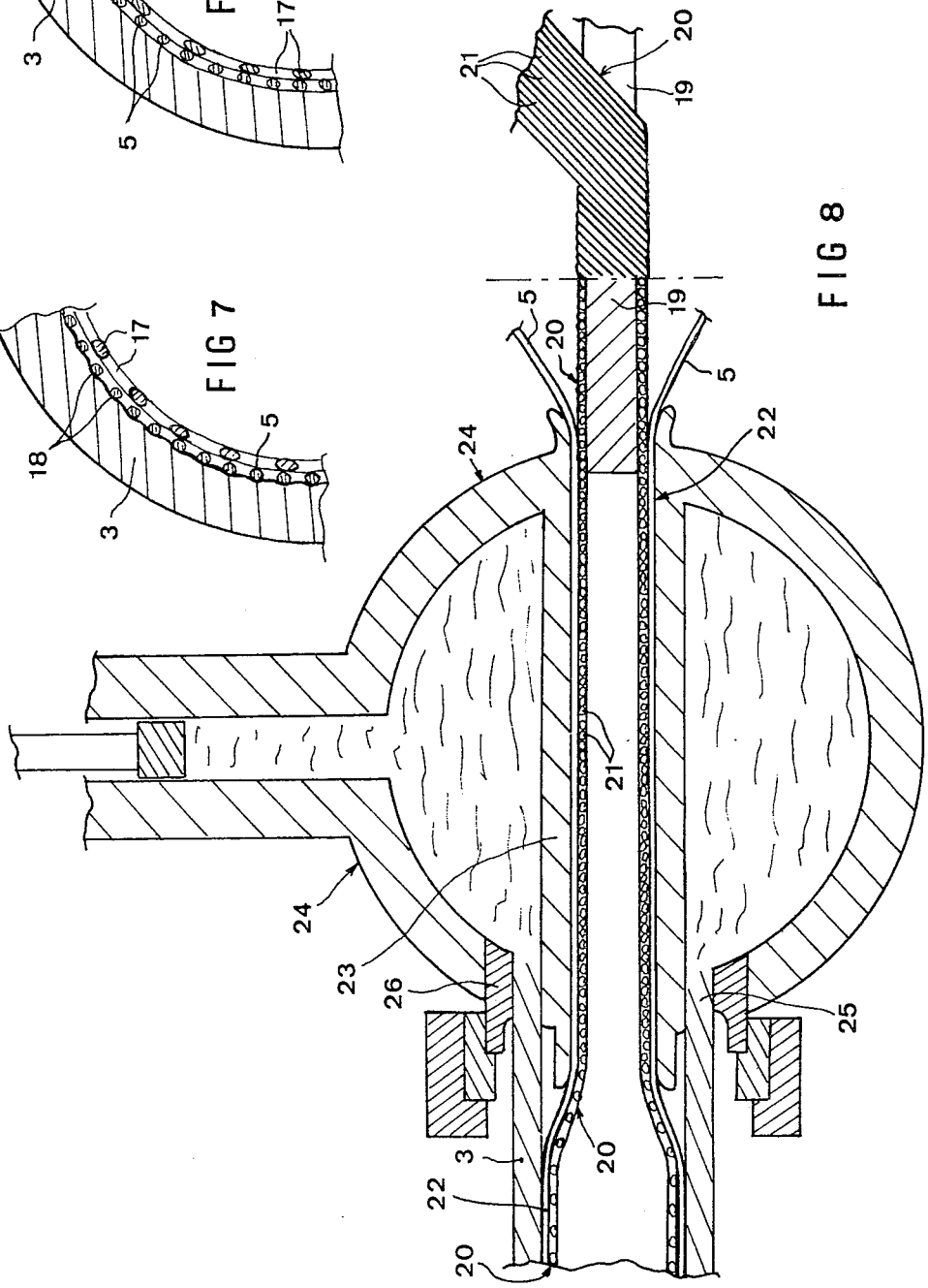
FIG 8

HEAT EXCHANGER WITH A CAPILLARY STRUCTURE FOR REFRIGERATION EQUIPMENT AND/OR HEAT PUMPS AND METHOD OF MAKING THE SAME

BACKGROUND OF THE INVENTION

The present invention relates to heat exchangers employing the energy given off in the course of a liquid/-vapor phase change or a vapor/liquid phase change of certain fluids and more particularly to such heat exchangers used in refrigeration equipment and/or heat pumps.

In machines of this type the heat exchangers are either constructed and designed for fulfilling a predetermined function either as an evaporator or as a condenser, or even designed to operate selectively as an evaporator and a condenser.

In case the heat exchanger is designed to be used exclusively as an evaporator it is underused since it is generally only half full and two-thirds full at best, in order to avoid "liquid knocking" in the compressor.

The only two-thirds or even half of the exchanger surface of the evaporator is therefore used when the flow of the fluid diminishes. Further, since the heat exchange is effected on small area cold surfaces, this contributes to the formation of frost in the case of air evaporators which of course is detrimental to efficiency.

In the case of condensers designed essentially to operate as such, for technological reasons the vapor reaching the condenser must be completely condensed at the exit. This requires over-dimensioning the condenser thereby increasing the cost of such a heat exchanger.

Finally, at the present time, the use of reversible refrigeration equipment requires that the exchangers be a compromise between evaporators and condensers, since they must operate equally as well as an evaporator or as a condenser, which accordingly in addition to the drawbacks specific to each type of exchanger referred to above, have low efficiencies.

In order to improve the heat exchange efficiency it has already been contemplated to line the inner wall of the heat exchanger tubes with a capillary structure to better distribute the liquid phase over the inner wall of such heat exchange tubes. The various solutions of this type which have been designed to now have not proved to be satisfactory in two important respects.

All contemplated capillary structures either do not provide capillarity over the entire inner surface of the tubes (this is particularly the case with woven or chained link metal fabric structures) or comprise baffles or obstacles slowing or retaining lubricating oil of the compressor of the system; some structures have both of these drawbacks.

OBJECT AND SUMMARY OF THE INVENTION

An object of the present invention is to simultaneously overcome both of these major drawbacks by providing a novel capillary structure for heat exchangers permitting heat exchange over the entire effective surface of the heat exchanger with substantially enhanced efficiency without hindering the flow of lubricating oil.

According to the invention there is provided a heat exchanger for regrigeration equipment and/or heat pumps, the heat exchanger having an array of tubular elements, in which an annular capillary structure is applied against the inner wall of the tubular elements of a heat exchanger. The capillary structure is characterized by a series of individual, smooth fibers of suitable material. The fibers are substantially rectilinear and parallel to the axes of the associated tubular elements. The fibers are regularly positioned in annular zones along inner walls of the tubular elements and means urge the fibers against the tubular elements, preferably along the entire length of the tubular elements.

Such an arrangement produces by means of the capillary action or "wick effect" due to the individual fibers along the entire inner wall surface of the tubular elements an excellent distribution of the liquid phase without in any way hindering the flow of oil since the fibers are smooth, rectilinear and parallel to the axes of the tubular elements.

Further, such a structure is particularly simple and inexpensive to make.

These and other features and advantages of the invention will be brought out in the description which follows of several embodiments of such capillary structure, as well as a method of making and installing a preferred embodiment of the capillary structure, which description is given by way of example only, with reference to the accompanying drawings.

BRIEF DESCRIPTION OF THE DRAWINGS

FIG. 6 shows a fragmentary cross-sectional view of a preferred embodiment of the capillary structure of the invention;

FIG. 7 is a view similar to that of FIG. 6 for an alternative embodiment of the capillary structure of the invention; and FIG. 8 is a longitudinal sectional view of apparatus for making and installing a capillary structure such as shown in FIGS. 6 or 7 associated with an extruder head for tubes in which the capillary structure is integrated.

DESCRIPTION OF THE PREFERRED EMBODIMENTS

Figure 1:
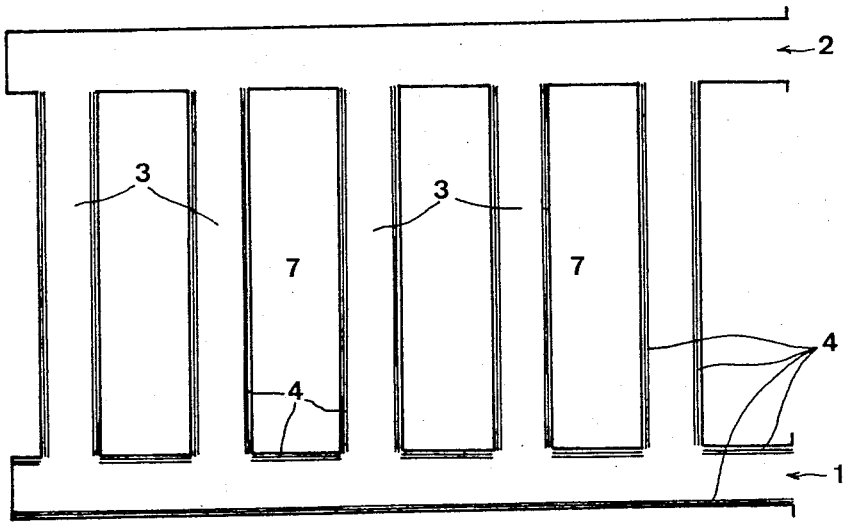
FIG. 1 illustrates a diagrammatic sectional view of a heat exchanger embodying the invention and operable as an evaporator or a condenser.

The heat exchanger of FIG. 1 comprises two headers 1 and 2 connected by an array or network of heat transfer tubes or tubular elements 3 which are rectilinear, parallel and identical and made of good heat conducting material such as copper for example.

According to the invention, all the tubes or tubular elements 3 comprise an annular capillary structure 4 over their entire length which capillary structure may even be provided in the liquid phase header (1 in FIG. 1) for the heat transfer fluid which may either add or remove heat.

Figure 2:
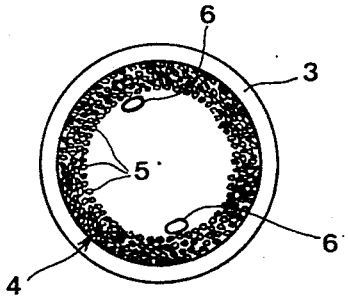
FIG. 2 illustrates a cross sectional view of a tubular element of the heat exchanger shown in FIG. 1.
Figure 3:
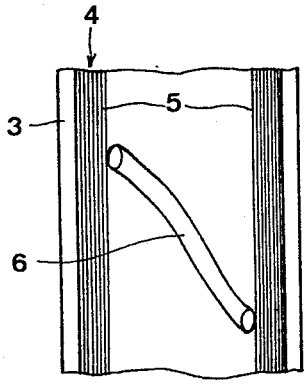
FIG. 3 illustrates a fragmentary longitudinal sectional view of a tubular element of the heat exchanger of FIG. 1.

FIGS. 2 and 3 illustrate an embodiment of the annular capillary structure 4 comprising a plurality of identical smooth, rectilinear, individual fibers 5 of constant diameter. These fibers 5 are separate though in contact with one another and with the inner wall of the tubes 1 and 3 and confined within an annular zone by any appropriate means. The fibers 5 are uniformly spaced or distributed within the annular zone, the radial thickness of the annular zone being a predetermined proportion of the inner diameter of the tube 1 or 3 in order to provide a flow and flow rate appropriate for the liquid phase fluid in tubes 1 and 3.

The fibers 5 line the inner walls of the tubes 1 and 3 along their entire length and are urged against the inner walls by any appropriate means. For example, as is known per se, a helical member 6 (see FIG. 3) defining a spring bears against the fibers 5 at the middle of the corresponding tube 1 or 3. The helical member 6 may of course be replaced by any other members adapted to urge the fibers against the inner walls of the tubes such as rings for example.

The fibers 5 and the means urging the fibers 5 against the inner walls of the tubes may be made of metal or plastic material or other materials compatible with the nature of the fluid flowing through the heat exchanger.

The diameter of the fibers 5 may vary insofar as the interstitial spaces between fibers determine the sought after capillary effect for the particular heat transfer fluid.

The arrangement of the fibers 5 in the header 1 provides a uniform distribution of the liquid to the tubes 3 while the fibers 5 of the capillary structure permit the "wetting" the entire effective surface of the tubes 3 and thereby ensure maximum heat transfer between the liquid phase heat transfer fluid in contact with the inner walls of the tubes 3 and the surrounding fluid.

Moreover, owing to the configuration of the interstitial spaces between the individual fibers 5 and between the fibers 5 and the inner wall of the tubes 3 and the absence of any transverse obstruction to the axial flow of the lubricating oil, the lubricating oil is not held back and flows freely. Consequently the compressor of the system is not likely to be short of oil.

When the working fluid reaches header at 1 in a liquid phase and exits at 2 in a gas phase, the exchanger operates as an evaporator and cools the fluid (e.g. air) flowing through the spaces 7 between and around the tubes 3. The working fluid flowing through the tubes 3 is then called a refrigerant.

If, on the contrary, the working fluid at 1 is in the gas phase and exits at 2 in the liquid phase, the working fluid is a heating fluid and it gives up part of its heat to the fluid flowing through spaces 7. When the fluid flowing through spaces 7 is air fins of heat conducting material such as aluminium, may advantageously be provided on exterior of the tubes 3. The exchanger then operates as a condenser.

The liquid phase is distributed along the tubes 3 gradually as it is formed and is discharged and the capillary structure 4 thus ensures good temperature distribution and correspondingly improves the heat transfer.

Thus, a heat exchanger such as the one illustrated in FIG. 1 operating as an evaporator has a greater efficiency than conventional evaporators whose tubes are typically half with the liquid phase and at most two-thirds full with the liquid phase. Owing to the capillary structure 4 of the invention in the evaporator constructed according to FIG. 1, the all inner walls of the tubes 3 are uniformly in contact with the liquid phase due to capillary action.

Therefore, when the fluid flowing through spaces 7 is air, premature cold spots causing the formation of frost are eliminated. It has been established that with an evaporator embodying the invention, frost is only formed when the temperature of the air flowing through spaces 7 is 4°–5° C. less than the temperature at which frost customarily forms on conventional evaporators.

The evaporator illustrated in FIG. 1 selectively operating as an evaporator or a condenser improves the performance coefficient of reversible machines in substantial proportions (of the order of 30–40%).

Figure 4:
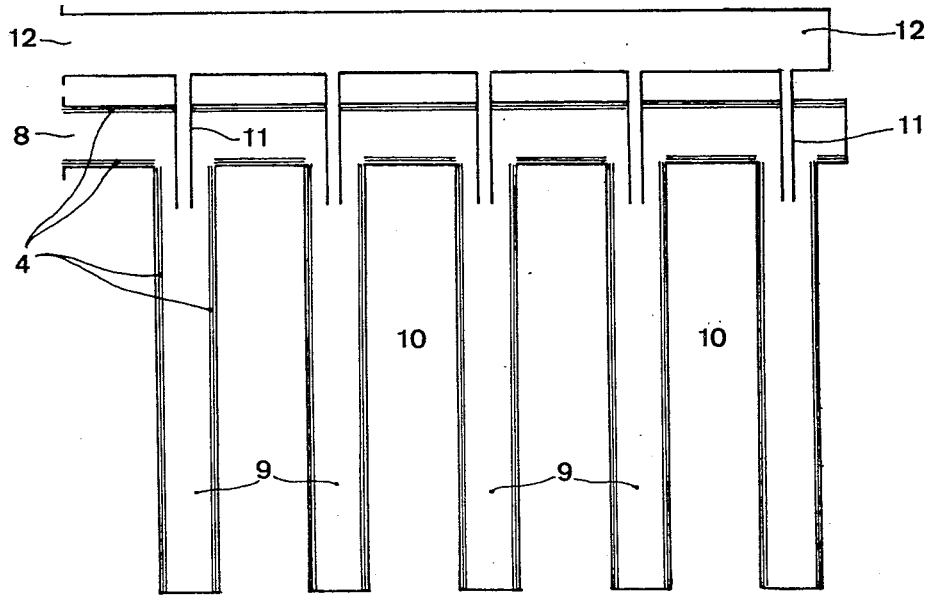
FIG. 4 shows a diagrammatic sectional view of an evaporator embodying the invention.

FIG. 4 illustrates a heat exchanger embodying the invention designed to operate essentially as an evaporator.

The refrigerant arrives in the liquid phase from the header 8 having a capillary structure 4 arranged on its inner walls as the header 1 in FIG. 1. The flow of the refrigerant is identical in each tube 9 likewise provided with a capillary structure 4 along the entire length of inner walls.

The tubes 3 have closed ends. The liquid refrigerant is uniformly distributed along each tube 9 and evaporates completely and uniformly under the effect of the heat supplied by the fluid flowing through spaces 10. The vapor produced is collected by the conduits 11 running off the header 12 for the discharge of the gas phase and extending into the open ends of the tubes 9, and coaxially therewith remote from the closed ends thereof.

Figure 5:
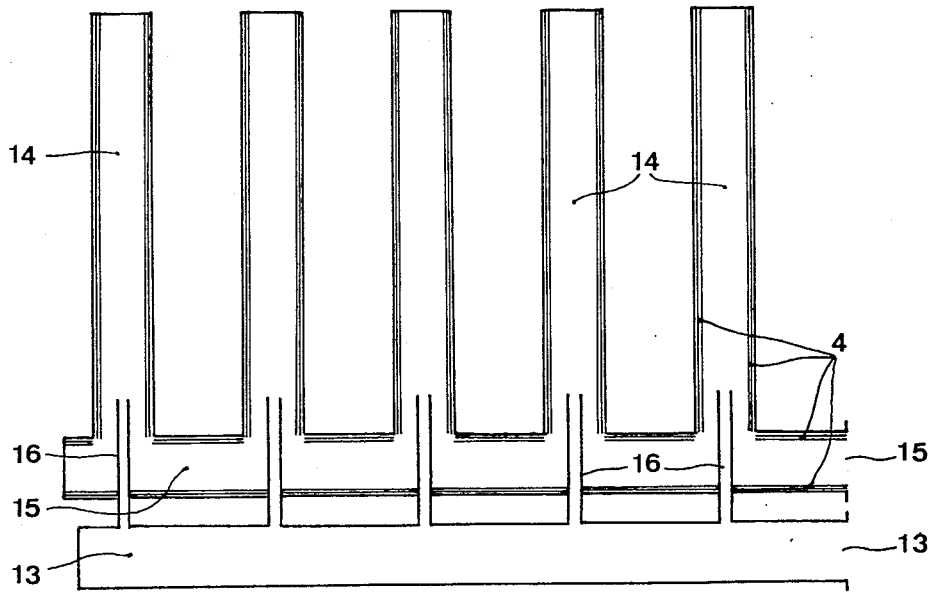
FIG. 5 illustrates a diagrammatic sectional view of a condenser embodying the invention.

FIG. 5 diagrammatically illustrates a heat exchanger embodying the invention designed to operate essentially as condenser.

The heating fluid enters the header 13 in the gas phase condenses into the liquid phase on contact with the inner walls of the heat transfer tubes 14 provided with an annular capillary structure 4 and exits in the liquid phase through the header 15 which is also equipped with an annular capillary structure 4.

The conducts 16 running off the header 13 for supplying the heating fluid in the liquid phase and extending into the open ends of the tubes 14, remoted from the closed ends, permit the uniform distribution of the heating fluid.

The invention is not intended to be limited to the above illustrated and described embodiments but on the contrary covers all modifications and alternatives namely those concerning the nature of the materials making up the fibers 5, their size, and spacing along the inner walls of the tubular members and the liquid phase headers as well as the means for urging the fibers against the inner walls of the tubes and maintaining them in position.

The fibers 5 may be arranged in a single layer of fibers more or less parallel to the axis of the corresponding tube and may be connected to one another or not.

FIG. 6 illustrates a modified embodiment which is particularly interesting owing to its simplicity and efficiency. In FIG. 6 is illustrated a single layer of parallel fibers 5 which are not connected to one another. The layers of fibers 5 are urged against the inner wall of the tube 3 by a resilient means comprising a layer of spring steel wire 17 (of other material having the similar resilient properties). The wires 17 are parallel and unconnected to one another and are helically coiled.

The fibers 5 have their axes substantially parallel to that of the corresponding tube 3 whereas the wires 17 are at a greater or lesser angle to the fibers 5.

The coil formed by the wires 17 does not comprise one single wire but a plurality of parallel wires, the plurality of wires being wound helically into a coil. The angle of inclination between the fibers 5 and the wires 17 can be varied easily while having a tight array or network of wires 17 in contact with the layer of fibers 5 at numerous points.

It should be noted that by proper sizing and distribution of the wires, the resilient layer formed by the wires increases the capillary effect produced by the capillary structure.

FIG. 7 illustrates a modified embodiment in which the inner wall of a tube 3 is not smooth but striated, grooved or corrugated. To this end grooves 18 or the like are formed by any suitable means parallel to the axis of the tube 3 and are preferably of widely spread V-shape. The grooves 18 have the function of facilitating the correct positioning of fibers 5, bearing in mind that the depth of the grooves or the like is less than the radius of the fibers 5 which are held in place by a resilient means identical to or different from the one shown in FIG. 6 and described above.

Further, the capillary structure may be comprised of two layers of fibers 5 of identical or different size characteristics which are parallel to one another and unconnected. The fibers of one layer are made at an angle to those of the other layer and the entire capillary structure is urged against the inner wall of the tube by resilient means which may or may not be identical to that of FIG. 6.

It should be noted that one of the layers may comprise fibers 5 parallel to the axis of the tube, the one layer being either in contact with the inner wall of the tube or in contact with the resilient means (vapor side).

FIG. 8 illustrates a method for making a capillary structure according to the embodiment of FIG. 6, and inserting the resulting capillary structure into an aluminium or light alloy extruded tube. A layer 20 of spring or similar wires 21 are, for example of steel, are helically wound into a coil around a cylindrical mandrel 19. The wires 21 of the layer 20 form connected turns on the mandrel 19.

The layer 20 of wires 21 is encased by a layer 22 of smooth individual fibers 5 parallel to the axis of the mandrel 19. The fibers 5 are regularly spaced in a single layer around the helical layer 20.

The layers 20 and 22 are guided and maintained in shape at the end of the mandrel 19 by a cylindrical sleeve 23 which is an extension of the mandrel 19 and integrated into an extruder head 24 coaxially to an annular extrusion orifice 25 for a tube 3 of aluminium for example, the orifice 25 being delimited between the sleeve 23 and a die 26.

As the tube 3 is progressively formed, it is automacally provided with the capillary layer 22 and the resilient holding layer 20, the layers 20 and 22 being formed continuously and introduced into the tube 3 at the same speed of advancement.

At the outlet end of the sleeve 23 the layers 20 and 22 are expanded radially under the resilient force of the spring wires 21 which urges the capillary layer 22 against the inner wall of the tube 3. The resulting tube with its capillary structure is in conformity with the embodiment of FIG. 6.

The tube may, alternatively, be provided with grooves such as those 18 in FIG. 7 in the course of extrusion.

The tube 3 may of course be produced by some other method for example by rolling a flat sheet and welding or from a strip coiled around the mandrel. Such techniques are perfectly well known to those skilled in the art. In this alternative method, the two layers 20 and 22 are introduced into the previously formed tube 3.

In the case where the fluid to be vaporized or condensed circulates at the exterior of the tubes, such a capillary structure is applied onto the outer face of the tube as it is the case in water condensers where water circulates within the tubes, the refrigerant fluid evaporating or condensing at the outer of said tubes.

What is claimed is:

1. In a heat exchanger for refrigeration equipment and/or heat pumps, in which the heat exchanger comprises an array of tubular elements, the invention comprising an annular capillary structure arranged in said tubular elements and comprising a series of individual, smooth, rectilinear fibers of suitable material arranged parallel to the longitudinal axes of said tubular elements, said fibers being regularly positioned in annular zones along the inner walls of said tubular elements, and means for urging said fibers against said inner walls of said tubular elements.

2. The invention of claim 1, wherein said fibers are unconnected and arranged in a single cylindrical layer.

3. The invention of claim 1 or 2, wherein said inner walls of said tubular element comprise longitudinal groove means for partially accomodating said fibers, the depth of said groove means being substantially less than the radius of the corresponding fibers.

4. The invention of claim 3, wherein said groove means are of spread V-shaped section.

5. The invention of claim 1, wherein said fibers are arranged in at least one annular cylindrical layer, said fibers being connected to one another and all of the same diameter.

6. The invention of claim 1, wherein said fibers are arranged in at least one layer, said fibers being connected to one another and of different diameters.

7. The invention of claim 1, wherein said fibers are in a first layer and are connected to one another, and other said fibers are arranged in a second layer parallel and unconnected to one another, said other fibers of said second layer being wound into a large pitch coil and lying against said first layer.

8. The invention of claim 1, wherein said means for urging said fibers against said inner walls of said tubular elements comprise for each said tubular element a layer of parallel, coiled, unconnected spring wires, said spring wires, said layer of spring wires and the resulting coil having dimensional characteristics such that said layer of spring wires enhances capillary action produced by said capillary structure.

9. The invention of claim 1 wherein said tubular elements of said array are rectilinear and parallel and connect a common rectilinear liquid phase header equipped with said capillary structure, said heat exchanger selectively operating as an evaporator and a condenser.

10. The invention of claim 1, wherein said means urging said fibers against said inner walls of said tubular elements urges said fibers against said inner walls along the entire length of said fibers.

11. A heat exchanger for refrigeration equipment and/or heat pumps, said heat exchanger comprising an array of tubular elements for carrying a working fluid and arranged in heat transfer relationship with a surrounding fluid, an annular capillary structure arranged in said tubular elements and comprising a series of individual, smooth, rectilinear fibers of suitable material arranged parallel to axes of said tubular elements, said fibers being regularly positioned in annular spaces along inner walls of said tubular elements, and means urging said fibers against said inner walls of said tubular elements.

12. The invention of claim 10, wherein said means urging said fibers against said inner walls of said tubular elements urges said fibers against said inner walls along the entire length of said fibers.

13. The invention of claim 10 wherein said tubular elements of said array are rectilinear and parallel and connect a common liquid phase header equipped with said capillary structure, said heat exchanger selectively operating as an evaporator and a condenser.

14. The heat exchanger of claim 10 or 11, operating as an evaporator, said tubular elements of said array being rectilinear and parallel and connecting a first header for incoming liquid phase working fluid, said tubular elements running off said first header and in closed circuit therewith, additional said annular capillary structure being disposed in said first header, a second header for exiting gas phase working fluid connected to said tubular elements by conduits extending coaxially into open ends of said tubular elements.

15. The heat exchanger of claim 10 or 11, operating as a condenser, wherein said tubular elements of said array are rectilinear and parallel and connected to a first header for incoming liquid phase working fluid, said tubular elements running off said first header and being connected in closed circuit therewith, a second header exiting gas phase working fluid connected to said tubular elements by conduits extending coaxially into open ends of said tubular elements.

* * * * *